US005984586A

United States Patent [19]

Wudtke

[11] Patent Number: 5,984,586

[45] Date of Patent: Nov. 16, 1999

[54] MOORING UNIT AND RETROFITTING METHOD

[75] Inventor: Donald J. Wudtke, Mount Vernon, Wash.

[73] Assignee: Continental Emsco Company, Houston, Tex.

[21] Appl. No.: 09/018,506

[22] Filed: Feb. 4, 1998

Related U.S. Application Data

[60] Provisional application No. 60/037,487, Feb. 4, 1997.

[51] Int. Cl.[6] ..... B63B 21/16; B66D 1/303

[52] U.S. Cl. ..... 405/224; 254/278; 114/293

[58] Field of Search ..... 405/195.1, 224; 254/284, 285, 278; 114/230, 293

[56] References Cited

U.S. PATENT DOCUMENTS

| | | | |
|---|---|---|---|
| 2,274,168 | 2/1942 | Scharpenberg | 254/285 |
| 3,300,187 | 1/1967 | Saxe et al. | 254/284 |
| 3,606,855 | 9/1971 | Saxonmeyer | 114/230 |
| 3,717,325 | 2/1973 | Peterson | 254/382 |
| 3,918,653 | 11/1975 | Harms et al. | 254/285 |
| 3,927,867 | 12/1975 | Herchenroder | 254/313 |
| 4,446,807 | 5/1984 | Johnson et al. | 114/230 |
| 4,476,801 | 10/1984 | Foster et al. | 114/230 |
| 4,497,471 | 2/1985 | Longberg et al. | 254/372 |
| 4,722,293 | 2/1988 | Foster et al. | 114/230 |
| 4,836,125 | 6/1989 | Ballantyne et al. | 114/294 |
| 4,841,898 | 6/1989 | Ballantyne | 114/293 |
| 4,862,821 | 9/1989 | Ballantyne | 114/293 |
| 4,878,452 | 11/1989 | Regan et al. | 114/293 |
| 5,544,608 | 8/1996 | Horton, III | 114/230 |
| 5,779,226 | 7/1998 | Wudtke | 254/278 |

*Primary Examiner*—David Bagnell
*Assistant Examiner*—Tara L. Mayo
*Attorney, Agent, or Firm*—Arnold White & Durkee

[57] ABSTRACT

A mooring unit and method of retrofitting a mooring unit are provided. Certain existing combination mooring units, of the type having two wire rope drums and two wildcats, are experiencing increased winch drive train component stress levels during operation when used in water deeper than they were designed for. Existing units are modified by providing left and right twin drum traction winch assemblies and additional winches. The existing wire rope drums are discarded, or reused with the additional winches. The additional winches are preferably mounted below the mooring unit. The twin drum traction winch assemblies, which deliver a constant winch pull force, are vertically mounted within the support flanges where the removed wire rope drums were previously mounted, without any modification to the support flanges.

65 Claims, 5 Drawing Sheets

MOORING UNIT AND RETROFITTING METHOD

RELATED APPLICATIONS

This application claims the benefit of U.S. Provisional application Ser. No. 60/037,487, filed Feb. 4, 1997.

BACKGROUND OF THE INVENTION

1. Field of the Invention

This invention relates generally to offshore drilling vessels, and more particularly to a mooring unit for use on an offshore drilling vessel and to a method for retrofitting an a mooring unit.

2. Description of the Related Art

An offshore drilling vessel is essentially a massive, floating, mobile vessel used in the offshore exploration of oil and gas. In broad terms, the typical offshore drilling vessel generally includes two large pontoon hulls, at least four vertical support columns, and a drilling platform. The pontoon hulls float in the water horizontally and are parallel to one another. At least two support columns are attached to and extend vertically upwardly from each pontoon hull. The drilling platform is horizontally attached upon the vertical columns. The vessel is equipped with the necessary drilling tools to drill an oil and gas well into the ocean floor. The vessel is towed from drilling site to drilling site by one or more boats. When the vessel arrives at a drilling site, the vessel must be anchored to the ocean floor before drilling begins. Each corner of the vessel is anchored to the ocean floor by at least one large anchor. Each anchor is raised and lowered by its own mooring unit. In very broad terms, a mooring unit is essentially a giant hoist. It is quite common for each corner of the vessel to be anchored to the ocean floor by two large anchors. In this situation, two mooring units are mounted to each corner of the vessel; this is referred to as an "eight-point" mooring system. The mooring units are normally mounted below the vessel's drilling platform on shelves attached to the vertical columns.

There are three basic types of mooring units: (1) a mooring "winch," which uses large diameter wire rope to raise and lower the anchor; (2) a mooring "windlass," which uses large chain to raise and lower the anchor; and, (3) a "combination" mooring unit, which has both a winch and a windlass, and uses a combination wire rope/chain mooring line to raise and lower the anchor. With all three types of mooring units, the offshore drilling vessel is also equipped with a "fairlead" for each mooring unit. A fairlead is essentially a pulley. The fairleads are mounted to the vertical columns directly below each mooring unit. The wire or chain exits the winch or windlass and passes around its corresponding fairlead before being connected to the anchor. In broad terms, all three types of mooring units have a frame, at least one brake, at least one drive motor, at least one gearbox, and an electrical control system. A typical mooring winch also has at least one drum, to hold the wire rope, and a levelwind for each drum, with the levelwind guiding the wire rope back and forth across the drum as it is spooled out and wound up. An example of a commercially available mooring winch is Model No. ETW-350, which is manufactured by Skagit Products, of Houston, Tex. A typical mooring windlass, on the other hand, has at least one "wildcat," instead of a drum and levelwind. A "wildcat" is essentially a sprocket which grabs the chain link-by-link and either pulls it in or feeds it out. An example of a commercially available mooring windlass is Model No. WMD-48, also manufactured by Skagit Products. When retrieving an anchor, a windlass does not wind up the chain like a winch winds up wire rope. Instead, as the anchor is being retrieved, the chain, used with a windlass, passes over the wildcat and into a "chain locker" located inside the vertical column to which the windlass is attached; the chain simply piles up on the floor of the chain locker.

A combination mooring unit includes both a mooring winch and a mooring windlass. Thus, the mooring line with a combination mooring unit is a combination of wire rope and chain. The winch provides a large drum to store the required length of wire rope, while the windlass handles the chain portion of the mooring line. An example of a commercially available combination mooring unit is Model No. ETW-350/52, also manufactured by Skagit Products. A typical anchor chain used in a combination mooring line has an approximate diameter of three and one-quarter inches, is approximately 4,400 feet in length, and weighs approximately 100 pounds per foot. A typical wire rope used in a combination mooring line has an approximate diameter of three and one-half inches, is approximately 5,600 feet in length, and weighs approximately 23 pounds per foot. With a combination mooring unit, the anchor is always attached directly to the chain portion of the mooring line; the wire rope portion of the mooring line connects to the chain portion of the mooring line, not to the anchor.

When an offshore drilling vessel equipped with combination mooring units is moved from one drilling site to another, the anchors are held in a "stowed" position against brackets which are attached to the vertical columns below the fairleads. The anchor is held against the brackets by the chain, and the chain is held in place by the wildcat on the windlass. The remainder of the chain portion of the mooring line is stored in the chain locker. Further, during transport, the wire rope is stored on the drum of the mooring winch, and is disconnected from the chain portion of the mooring line. When the vessel arrives at the drilling site, the vessel must be anchored before drilling begins. To anchor the vessel, each windlass lowers its anchor away from its bracket and onto a boat. The boat then carries the anchor away from the vessel in the desired direction. The boat is advised to stop when most of the chain portion of the mooring line has been payed out. As known to those skilled in the art, when the chain has been payed out, a "tri-link" is used to connect the chain to the wire rope. At this point, the mooring line becomes a combination chain and wire rope mooring line, and the combination mooring line is controlled by the winch instead of the windlass. After the connection has been made, the boat is signaled to continue carrying the anchor to the desired location, thereby unwinding wire rope from the winch drum. When the boat reaches the desired location, the anchor is dropped to the ocean floor. After all anchors have been dropped in this manner, the drilling process may begin. When it is desired to move the drilling vessel to another drilling site, each anchor must be retrieved and secured to its corresponding vertical column as explained above. As explained below, it is during the process of retrieving the anchors with combination wire rope/chain mooring lines that the problem solved by the present invention arises.

At the beginning of the process of retrieving each anchor, in a typical situation, there is approximately 4,400 feet of anchor chain and approximately 5,600 feet of wire rope in the water. Thus, in this scenario, the total length of the combination mooring line in the water between the drilling vessel and each anchor is approximately 10,000 feet (or approximately 1.9 miles). A typical water depth in this scenario may be approximately 5,000 feet. One end of the chain is connected to the anchor and the other end is connected to one end of the wire rope. The other end of the wire rope is connected to the winch drum. At the beginning of the anchor retrieval process, the wire rope is at a layer very near the core of the drum. When the wire rope layer is very near the drum core, the winch is capable of pulling on the anchor with a much greater force ("winch pull force") than when the drum is full and the wire rope is at its outer layer. This is based upon the physical principle that torque is a product of force and distance. In this case, the torque delivered by the motor to the wire rope drum remains constant, and the distance from the drum core to the wire rope layer (i.e., the radius of the wire rope layer) varies. As the radius of the wire rope layer increases, the force must decrease since the torque remains constant. Thus, as the anchor is retrieved by the winch, and as the wire rope is evenly spooled by the levelwind onto the winch drum, the wire rope layer gradually moves away from the drum core, and the winch pull force gradually decreases. The existing combination mooring units presently in operation were designed with winches easily having the necessary winch pull force at the outer wire rope layer to haul the wire rope, chain and anchor up to a level high enough so that the chain could be connected directly to the windlass, and disconnected from the wire rope. However, as companies have extended their exploration efforts into deeper and deeper water, it has become necessary to utilize longer and longer lengths of chain and wire rope, thereby rendering inapplicable the original design parameters for the existing combination mooring units. Thus, the existing combination mooring units now in operation are being used under conditions more strenuous that those they were originally designed for. As will now be explained, a specific problem has arisen as a result of taking drilling vessels equipped with existing combination mooring units into greater water depths.

The specific problem occurs during the process of retrieving the anchors. More particularly, the problem occurs when the combination mooring line is still being reeled in by the winch. Stated differently, the problem occurs before the chain has been connected to the windlass and disconnected from the wire rope. As the winch is reeling in the anchor, and as the wire rope reaches the outer layer, where the winch pull force is at its lowest, the drive train component stress levels and deflections are highest. When in deeper water and operating parameters are more demanding than the original design parameters, the winch drive train component stress levels are further increased. If the retrieval loads continue to increase, the winch will simply stall. Thus, there is a need for a combination mooring unit having a winch with the capacity to raise the wire rope, chain, and anchor high enough to connect the chain directly to the windlass, and disconnect the chain from the wire rope, without exceeding the allowable design criteria, and without stalling. In addition, there is a need for an efficient and cost effective way to modify the existing combination mooring units presently in operation to meet these needs, instead of completely scrapping them and replacing them with new units. The present invention, as explained below, was developed in response to these needs.

SUMMARY OF THE INVENTION

In a broad aspect, the invention is a method of retrofitting a mooring unit of the type used on an offshore drilling or production platform to pay out and retrieve a combination wire rope and chain mooring line, the mooring unit having a first combination mooring unit and a second combination mooring unit, the first combination mooring unit having a first support frame, a first wire rope drum for holding a first length of mooring wire rope, a first levelwind assembly for evenly spooling the first section of wire rope onto the first wire rope drum, a first wildcat rotatably mounted to the first support frame for retrieving and paying out a first section of mooring chain, the first support frame having a first wire rope support flange and a second wire rope support flange, the first wire rope drum being rotatably mounted within the first and second wire rope support flanges, the second combination mooring unit having a second support frame, a second wire rope drum for holding a second length of mooring wire rope, a second levelwind assembly for evenly spooling the second section of wire rope onto the second wire rope drum, a second wildcat rotatably mounted to the second support frame for retrieving and paying out a second section of mooring chain, the second support frame having a third wire rope support flange and a fourth wire rope support flange, the second wire rope drum being rotatably mounted within the third and fourth wire rope support flanges, the mooring unit further including a motor and means for transmitting power from the motor to the first wildcat, second wildcat, first wire rope drum, and second wire rope drum, the retrofitting method comprising the steps of: removing the first wire rope drum and the first levelwind assembly from the first and second wire rope support flanges; removing the second wire rope drum and the second levelwind assembly from the third and fourth wire rope support flanges; mounting a first traction winch to the first and second wire rope support flanges to haul in and pay out the first section of wire rope; mounting a second traction winch to the third and fourth wire rope support flanges to haul in and pay out the second section of wire rope; mounting a third wire rope drum assembly on the offshore platform adjacent the mooring unit to store the first section of wire rope; and, mounting a fourth wire rope drum assembly on the offshore platform adjacent the mooring unit to store the second section of wire rope. Another feature of this aspect of the present invention is that the first traction winch is mounted to the first and second wire rope support flanges without making any modification to the first or second wire rope support flanges, and wherein the second traction winch is mounted to the third and fourth wire rope support flanges without making any modification to the third or fourth wire rope support flanges. Another feature of this aspect of the present invention is that the first traction winch is mounted to the first and second wire rope support flanges without making any modification to the power transmission means, and wherein the second traction winch is mounted to the third and fourth wire rope support flanges without making any modification to the power transmission means. Another feature of this aspect of the present invention is that the first and second support frames are connected to the offshore platform, there being a first and a second point of contact between the first wire rope support flange and the platform, a third and a fourth point of contact between the second wire rope support flange and the platform, a fifth and a sixth point of contact between the third wire rope support flange and the platform, and a seventh and an eighth point of contact between the fourth wire rope support flange and the platform, such that forces associated with the mooring line are transferred through the points of contact to the platform, and wherein the first traction winch is mounted to the first and second wire rope support flanges without altering the first, second, third or fourth contact points, and the second traction winch is mounted to the third and fourth wire rope support flanges without altering the fifth, sixth, seventh, or eighth contact points. Another feature of this aspect of the present invention is that the first and second support frames are connected to the offshore platform, there being a plurality of points of contact between the support flanges and the platform, such that forces associated with the mooring line are transferred through the points of contact to the platform, and wherein the first traction winch is mounted to the first and second wire rope support flanges without altering any of the contacts points, and the second traction winch is mounted to the third and fourth wire rope support flanges without altering any of the contact points. Another feature of this aspect of the present invention is that the first and second traction winches are vertically mounted to the support flanges. Another feature of this aspect of the present invention is that the third wire rope drum assembly is mounted below the mooring unit such that the first section of wire rope is directed from the third wire rope drum assembly upwardly to the first traction winch, and wherein the fourth wire rope drum assembly is mounted below the mooring unit such that the second section of wire rope is directed from the fourth wire rope drum assembly upwardly to the second traction winch. Another feature of this aspect of the present invention is that the method may further include the steps of mounting a first pulley to the offshore platform and mounting a second pulley to the offshore platform, such that the first section of wire rope is directed from the third wire rope drum assembly around the first pulley and then upwardly to the first traction winch, and the second section of wire rope is directed from the fourth wire rope drum assembly around the second pulley and then upwardly to the second traction winch. Another feature of this aspect of the present invention is that the first pulley is mounted to the offshore platform directly beneath a first left-most groove on a first bottom drum of the first traction winch, and the second pulley is mounted to the offshore platform directly beneath a second left-most groove on a second bottom drum of the second traction winch. Another feature of this aspect of the present invention is that the third wire rope drum assembly includes the first wire rope drum and first levelwind assembly. Another feature of this aspect of the present invention is that the third wire rope drum assembly is mounted below the mooring unit such that the first section of wire rope is directed from the third wire rope drum assembly upwardly to the first traction winch. Another feature of this aspect of the present invention is that the method may further include the steps of mounting a first pulley to the offshore platform such that the first section of wire rope is directed from the third wire rope drum assembly around the first pulley and then upwardly to the first traction winch. Another feature of this aspect of the present invention is that the first pulley is mounted to the offshore platform directly beneath a first left-most groove on a first bottom drum of the first traction winch. Another feature of this aspect of the present invention is that the fourth wire rope drum assembly includes the second wire rope drum and second levelwind assembly. Another feature of this aspect of the present invention is that the fourth wire rope drum assembly is mounted below the mooring unit such that the second section of wire rope is directed from the second wire rope drum assembly upwardly to the second traction winch. Another feature of this aspect of the present invention is that the method may further include the steps of mounting a second pulley to the offshore platform, such that the second section of wire rope is directed from the fourth wire rope drum assembly around the second pulley and then upwardly to the second traction winch. Another feature of this aspect of the present invention is that the second pulley is mounted to the offshore platform directly beneath a second left-most groove on a second bottom drum of the second traction winch.

In another aspect, the present invention may be a method of retrofitting a mooring unit of the type used on an offshore drilling or production platform to pay out and retrieve a combination wire rope and chain mooring line, the mooring unit having a first combination mooring unit, the first combination mooring unit having a first support frame, a first wire rope drum for holding a first length of mooring wire rope, a first levelwind assembly for evenly spooling the first section of wire rope onto the first wire rope drum, a first wildcat rotatably mounted to the first support frame for retrieving and paying out a first section of mooring chain, the first support frame having a first wire rope support flange and a second wire rope support flange, the first wire rope drum being rotatably mounted within the first and second wire rope support flanges, the mooring unit further including a motor and means for transmitting power from the motor to the first wildcat and first wire rope drum, the retrofitting method comprising the steps of: removing the first wire rope drum and the first levelwind assembly from the first and second wire rope support flanges; mounting a first traction winch to the first and second wire rope support flanges to haul in and pay out the first section of wire rope; and, mounting a third wire rope drum assembly on the offshore platform adjacent the mooring unit to store the first section of wire rope. Another feature of this aspect of the present invention is that the first traction winch is mounted to the first and second wire rope support flanges without making any modification to the first or second wire rope support flanges. Another feature of this aspect of the present invention is that the first traction winch is mounted to the first and second wire rope support flanges without making any modification to the power transmission means. Another feature of this aspect of the present invention is that the first support frame is connected to the offshore platform, there being a first and a second point of contact between the first wire rope support flange and the platform, and a third and a fourth point of contact between the second wire rope support flange and the platform, such that forces associated with the mooring line are transferred through the points of contact to the platform, and wherein the first traction winch is mounted to the first and second wire rope support flanges without altering the first, second, third or fourth contact points. Another feature of this aspect of the present invention is that the first support frame is connected to the offshore platform, there being a plurality of points of contact between the support flange and the platform, such that forces associated with the mooring line are transferred through the points of contact to the platform, and wherein the first traction winch is mounted to the first and second wire rope support flanges without altering any of the contacts points. Another feature of this aspect of the present invention is that the first traction winches is vertically mounted to the first support flange. Another feature of this aspect of the present invention is that the third wire rope drum assembly is mounted below the mooring unit such that the first section of wire rope is directed from the third wire rope drum assembly upwardly to the first traction winch. Another feature of this aspect of the present invention is that the method may further include the steps of mounting a first pulley to the offshore platform such that the first section of wire rope is directed from the third wire rope drum assembly around the first pulley and then upwardly to the first traction winch. Another feature of this aspect of the present invention is that the first pulley is mounted to the offshore platform directly beneath a first left-most groove on a first bottom drum of the first traction winch. Another feature of this aspect of the present invention is that the third wire rope drum assembly includes the first wire rope drum and first levelwind assembly. Another feature of this aspect of the present invention is that the third wire rope drum assembly is mounted below the mooring unit such that the first section of wire rope is directed from the third wire rope drum assembly upwardly to the first traction winch. Another feature of this aspect of the present invention is that the method may further include the steps of mounting a first pulley to the offshore platform such that the first section of wire rope is directed from the third wire rope drum assembly around the first pulley and then upwardly to the first traction winch. Another feature of this aspect of the present invention is that the first pulley is mounted to the offshore platform directly beneath a first left-most groove on a first bottom drum of the first traction winch.

In still another aspect, the present invention may be a method of retrofitting a mooring unit of the type used on an offshore drilling or production platform to pay out and retrieve a wire rope mooring line, the mooring unit having a first winch and a second winch, the first winch having a first support frame, a first wire rope drum for holding a first length of mooring wire rope, a first levelwind assembly for evenly spooling the first section of wire rope onto the first wire rope drum, the first support frame having a first wire rope support flange and a second wire rope support flange, the first wire rope drum being rotatably mounted within the first and second wire rope support flanges, the second winch having a second support frame, a second wire rope drum for holding a second length of mooring wire rope, a second levelwind assembly for evenly spooling the second section of wire rope onto the second wire rope drum, the second support frame having a third wire rope support flange and a fourth wire rope support flange, the second wire rope drum being rotatably mounted within the third and fourth wire rope support flanges, the mooring unit further including a motor and means for transmitting power from the motor to the first wire rope drum and second wire rope drum, the retrofitting method comprising the steps of: removing the first wire rope drum and the first levelwind assembly from the first and second wire rope support flanges; removing the second wire rope drum and the second levelwind assembly from the third and fourth wire rope support flanges; mounting a first traction winch to the first and second wire rope support flanges to haul in and pay out the first section of wire rope; mounting a second traction winch to the third and fourth wire rope support flanges to haul in and pay out the second section of wire rope; mounting a third wire rope drum assembly on the offshore platform adjacent the mooring unit to store the first section of wire rope; and, mounting a fourth wire rope drum assembly on the offshore platform adjacent the mooring unit to store the second section of wire rope. Another feature of this aspect of the present invention is that the first traction winch is mounted to the first and second wire rope support flanges without making any modification to the first or second wire rope support flanges, and wherein the second traction winch is mounted to the third and fourth wire rope support flanges without making any modification to the third or fourth wire rope support flanges. Another feature of this aspect of the present invention is that the first traction winch is mounted to the first and second wire rope support flanges without making any modification to the power transmission means, and wherein the second traction winch is mounted to the third and fourth wire rope support flanges without making any modification to the power transmission means. Another feature of this aspect of the present invention is that the first and second support frames are connected to the offshore platform, there being a first and a second point of contact between the first wire rope support flange and the platform, a third and a fourth point of contact between the second wire rope support flange and the platform, a fifth and a sixth point of contact between the third wire rope support flange and the platform, and a seventh and an eighth point of contact between the fourth wire rope support flange and the platform, such that forces associated with the mooring line are transferred through the points of contact to the platform, and wherein the first traction winch is mounted to the first and second wire rope support flanges without altering the first, second, third or fourth contact points, and the second traction winch is mounted to the third and fourth wire rope support flanges without altering the fifth, sixth, seventh, or eighth contact points. Another feature of this aspect of the present invention is that the first and second support frames are connected to the offshore platform, there being a plurality of points of contact between the support flanges and the platform, such that forces associated with the mooring line are transferred through the points of contact to the platform, and wherein the first traction winch is mounted to the first and second wire rope support flanges without altering any of the contacts points, and the second traction winch is mounted to the third and fourth wire rope support flanges without altering any of the contact points. Another feature of this aspect of the present invention is that the first and second traction winches are vertically mounted to the support flanges. Another feature of this aspect of the present invention is that the third wire rope drum assembly is mounted below the mooring unit such that the first section of wire rope is directed from the third wire rope drum assembly upwardly to the first traction winch, and wherein the fourth wire rope drum assembly is mounted below the mooring unit such that the second section of wire rope is directed from the fourth wire rope drum assembly upwardly to the second traction winch. Another feature of this aspect of the present invention is that the method may further include the steps of mounting a first pulley to the offshore platform and mounting a second pulley to the offshore platform, such that the first section of wire rope is directed from the third wire rope drum assembly around the first pulley and then upwardly to the first traction winch, and the second section of wire rope is directed from the fourth wire rope drum assembly around the second pulley and then upwardly to the second traction winch. Another feature of this aspect of the present invention is that the first pulley is mounted to the offshore platform directly beneath a first left-most groove on a first bottom drum of the first traction winch, and the second pulley is mounted to the offshore platform directly beneath a second left-most groove on a second bottom drum of the second traction winch. Another feature of this aspect of the present invention is that the third wire rope drum assembly includes the first wire rope drum and first levelwind assembly. Another feature of this aspect of the present invention is that the third wire rope drum assembly is mounted below the mooring unit such that the first section of wire rope is directed from the third wire rope drum assembly upwardly to the first traction winch. Another feature of this aspect of the present invention is that the method may further include the step of mounting a first pulley to the offshore platform such that the first section of wire rope is directed from the third wire rope drum assembly around the first pulley and then upwardly to the first traction winch. Another feature of this aspect of the present invention is that the first pulley is mounted to the offshore platform directly beneath a first left-most groove on a first bottom drum of the first traction winch. Another feature of this aspect of the present invention is that the fourth wire rope drum assembly includes the second wire rope drum and second levelwind assembly. Another feature of this aspect of the present invention is that the fourth wire rope drum assembly is mounted below the mooring unit such that the second section of wire rope is directed from the second wire rope drum assembly upwardly to the second traction winch. Another feature of this aspect of the present invention is that the method may further include the steps of mounting a second pulley to the offshore platform, such that the second section of wire rope is directed from the fourth wire rope drum assembly around the second pulley and then upwardly to the second traction winch. Another feature of this aspect of the present invention is that the second pulley is mounted to the offshore platform directly beneath a second left-most groove on a second bottom drum of the second traction winch.

In yet another aspect, the present invention may be a method of retrofitting a mooring unit of the type used on an offshore drilling or production platform to pay out and retrieve a wire rope mooring line, the mooring unit having a first winch, the first winch having a first support frame, a first wire rope drum for holding a first length of mooring wire rope, a first levelwind assembly for evenly spooling the first section of wire rope onto the first wire rope drum, the first support frame having a first wire rope support flange and a second wire rope support flange, the first wire rope drum being rotatably mounted within the first and second wire rope support flanges, the mooring unit further including a motor and means for transmitting power from the motor to the first wire rope drum, the retrofitting method comprising the steps of: removing the first wire rope drum and the first levelwind assembly from the first and second wire rope support flanges; mounting a first traction winch to the first and second wire rope support flanges to haul in and pay out the first section of wire rope; and, mounting a third wire rope drum assembly on the offshore platform adjacent the mooring unit to store the first section of wire rope. Another feature of this aspect of the present invention is that the first traction winch is mounted to the first and second wire rope support flanges without making any modification to the first or second wire rope support flanges. Another feature of this aspect of the present invention is that the first traction winch is mounted to the first and second wire rope support flanges without making any modification to the power transmission means. Another feature of this aspect of the present invention is that the first support frame is connected to the offshore platform, there being a first and a second point of contact between the first wire rope support flange and the platform, and a third and a fourth point of contact between the second wire rope support flange and the platform, such that forces associated with the mooring line are transferred through the points of contact to the platform, and wherein the first traction winch is mounted to the first and second wire rope support flanges without altering the first, second, third or fourth contact points. Another feature of this aspect of the present invention is that the first support frame is connected to the offshore platform, there being a plurality of points of contact between the support flange and the platform, such that forces associated with the mooring line are transferred through the points of contact to the platform, and wherein the first traction winch is mounted to the first and second wire rope support flanges without altering any of the contacts points. Another feature of this aspect of the present invention is that the first traction winches is vertically mounted to the first support flange. Another feature of this aspect of the present invention is that the third wire rope drum assembly is mounted below the mooring unit such that the first section of wire rope is directed from the third wire rope drum assembly upwardly to the first traction winch. Another feature of this aspect of the present invention is that the method may further include the steps of mounting a first pulley to the offshore platform such that the first section of wire rope is directed from the third wire rope drum assembly around the first pulley and then upwardly to the first traction winch. Another feature of this aspect of the present invention is that the first pulley is mounted to the offshore platform directly beneath a first left-most groove on a first bottom drum of the first traction winch. Another feature of this aspect of the present invention is that the third wire rope drum assembly includes the first wire rope drum and first levelwind assembly. Another feature of this aspect of the present invention is that the third wire rope drum assembly is mounted below the mooring unit such that the first section of wire rope is directed from the third wire rope drum assembly upwardly to the first traction winch. Another feature of this aspect of the present invention is that the method may further include the step of mounting a first pulley to the offshore platform such that the first section of wire rope is directed from the third wire rope drum assembly around the first pulley and then upwardly to the first traction winch. Another feature of this aspect of the present invention is that the first pulley is mounted to the offshore platform directly beneath a first left-most groove on a first bottom drum of the first traction winch.

In another aspect, the present invention may be a system for mooring an offshore drilling or production platform to the ocean floor with a combination wire rope and chain mooring line connected to an anchor, the system comprising: a first combination mooring unit having a first support frame, a first wildcat rotatably mounted to the first support frame for retrieving and paying out a first section of mooring chain, the first support frame having a first wire rope support flange and a second wire rope support flange, a first traction winch mounted to the first and second wire rope support flanges to haul in and pay out a first section of wire rope; a second combination mooring unit having a second support frame, a second wildcat rotatably mounted to the second support frame for retrieving and paying out a second section of mooring chain, the second support frame having a third wire rope support flange and a fourth wire rope support flange, a second traction winch mounted to the third and fourth wire rope support flanges to haul in and pay out a second section of wire rope; a motor; means for transmitting power from the motor to the first wildcat, second wildcat, first traction winch, and second traction winch; a first wire rope drum assembly mounted to the offshore platform adjacent the first combination mooring unit to store the first section of wire rope; and, a second wire rope drum assembly mounted to the offshore platform adjacent the second combination mooring unit to store the second section of wire rope. Another feature of this aspect of the present invention is that the first and second traction winches are vertically mounted to the support flanges. Another feature of this aspect of the present invention is that the first wire rope drum assembly is mounted below the first combination mooring unit such that the first section of wire rope is directed from the third wire rope drum assembly upwardly to the first traction winch, and wherein the second wire rope drum assembly is mounted below the second combination mooring unit such that the second section of wire rope is directed from the second wire rope drum assembly upwardly to the second traction winch. Another feature of this aspect of the present invention is that the system may further include a first pulley mounted to the offshore platform and a second pulley mounted to the offshore platform, the first section of wire rope begin directed from the first wire rope drum assembly around the first pulley and then upwardly to the first traction winch, and the second section of wire rope being directed from the second wire rope drum assembly around the second pulley and then upwardly to the second traction winch. Another feature of this aspect of the present invention is that the first pulley is mounted to the offshore platform directly beneath a first left-most groove on a first bottom drum of the first traction winch, and the second pulley is mounted to the offshore platform directly beneath a second left-most groove on a second bottom drum of the second traction winch.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the claims to be filed in any future non-provisional application based upon this provisional application.

DETAILED DESCRIPTION OF THE INVENTION

Figure 1:
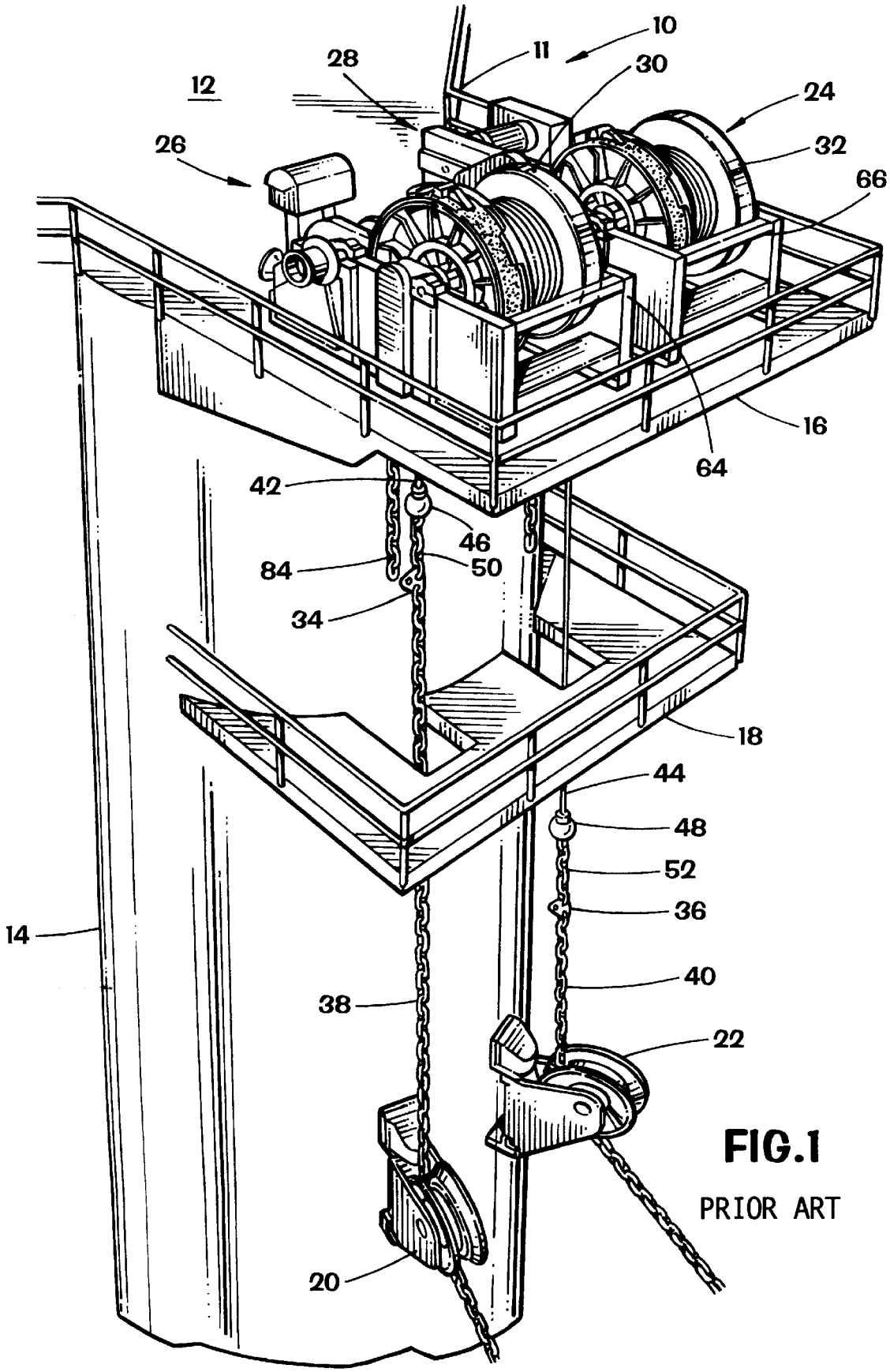
FIG.1 PRIOR ART
FIG. 1 is a perspective view of a double-drum/double-wildcat combination mooring unit, of the type currently in operation and in need of modification, mounted to a corner of an offshore drilling vessel.

To describe the improved mooring unit of the present invention, it will first be useful to describe an existing combination mooring unit of the type presently in operation and in need of modification. Referring to the drawings in detail, wherein like numerals denote identical elements throughout the several views, there is shown in FIG. 1 a perspective view of a corner 11 of an offshore drilling vessel 10 having a horizontal drilling platform 12 attached upon a vertical support column 14. Attached to the column 14 are a mooring unit platform 16, a cross-over platform 18, and a left and right fairlead 20 and 22. A combination mooring unit 24 of the type presently in operation and in need of modification is attached upon the mooring unit platform 16. The combination mooring unit 24 actually includes two combination mooring units as the term "combination mooring unit" has been used above. The mooring unit 24 includes a left combination mooring unit 26 and a right combination mooring unit 28. Each unit 26 and 28 has its own winch and its own windlass. More particularly, each unit 26 and 28 has its own wire rope drum 30 and 32 and its own wildcat (not visible in this Figure). A mooring unit such as unit 24 is often referred to as a double-drum/double-wildcat combination mooring unit. When each corner 11 of a drilling vessel 10 is equipped with a double double-wildcat combination mooring unit, such as mooring unit 24, the vessel 10 is said to have an "eight-point" mooring system. As such, each of the vessel's corners 11 is anchored to the ocean floor by two anchors (not shown).

FIG. 1 illustrates how the combination wire rope and chain mooring line passes through and under the fairleads 20 and 22, and also shows two "tri-links" 34 and 36 which are used to connect the chain portions 38 and 40 of the mooring line to the wire rope portions 42 and 44 of the mooring line. The ends of the wire rope portions 42 and 44 are terminated with connectors 46 and 48, to which are attached short chain sections 50 and 52. The short chain sections 50 and 52 are connected to the tri-links 34 and 36. Workers make the connections between the wire rope and chain portions of the mooring line from the cross-over platform 18.

Figure 2:
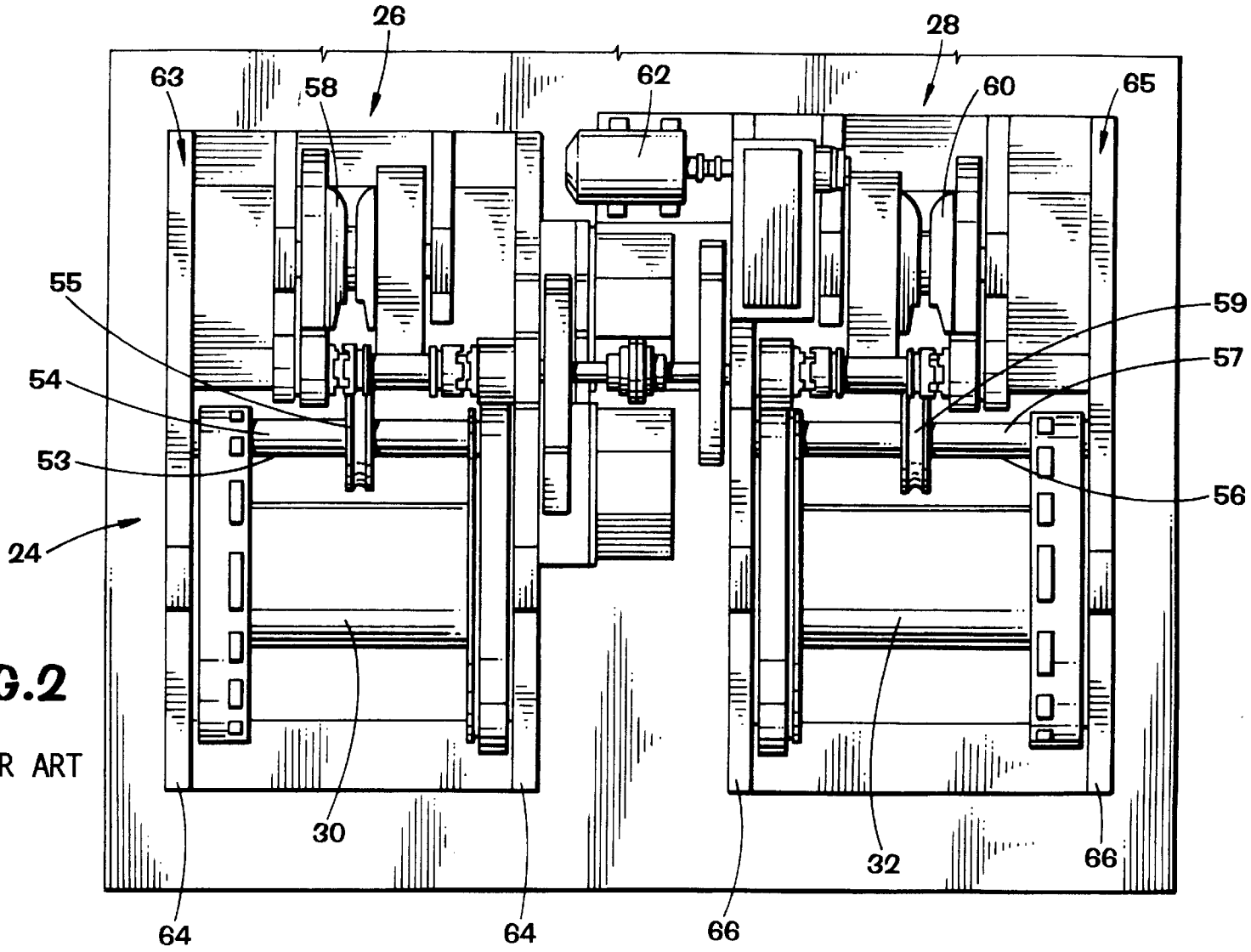
FIG.2 PRIOR ART
FIG. 2 is a top view of the mooring unit shown in FIG. 1.

FIG. 2 is a top view of the double drum/double-wildcat mooring unit 24 shown in FIG. 1 with the wire rope 42, 44 and chain 38, 40 not being shown for clarity. FIG. 2 shows the left and right combination mooring units 26 and 28, and their respective wire rope drums 30 and 32. The wire rope drums 30 and 32 have corresponding levelwinds 53 and 56. Each levelwind 53, 56 has a carrier shaft 54, 57, a sheave 55, 59 and a worm shaft (not shown); the worm shafts, which drive the carrier shafts 54, 57, are disposed directly beneath the carrier shafts 54, 57. The mooring units 26 and 28 include wildcats 58 and 60. Both mooring units 26 and 28 are powered by a motor 62. Power is transferred from the motor 62 to the wire rope drums 30 and 32 and to the wildcats 58 and 60 by a series of gears, shafts and bearings in a conventional manner. Brakes are also connected in a conventional manner to the mooring unit 24 to control the wire rope drums 30 and 32 and the wildcats 58 and 60. The left combination mooring unit 26 has a support frame 63, sometimes referred to as the "auxiliary frame," and the right combination mooring unit 28 has a support frame 65, sometimes referred to as the "main frame." The left, or auxiliary, support frame 63 has left wire drum support flanges 64, and the right, or main, support frame 65 has right wire drum support flanges 66. The left wire rope drum 30 is rotatably mounted in the left wire rope drum support flanges 64, and the right wire rope drum 32 is rotatably mounted in the right wire rope drum support flanges 66. Both support frames 63, 65 are mounted to the mooring unit platform 16 (see FIG. 1).

Figure 5:
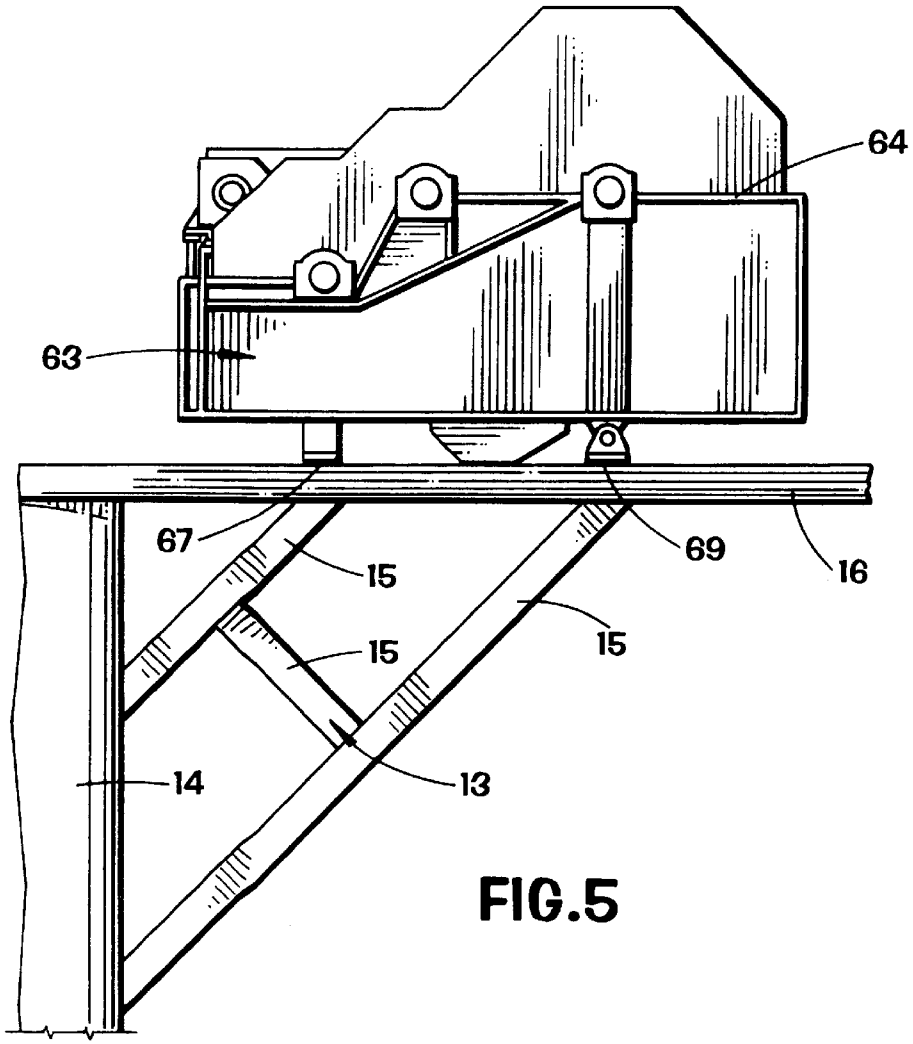
FIG. 5 is a side elevation view of the mooring unit shown in FIG. 2.

As best shown in FIG. 5, which is a side elevation view of the mooring unit 24 as shown in FIG. 2, as known in the art, there are four points of contact, two on each of the flanges 64 or 66, between each support frame 63, 65 and the mooring unit platform 16. Thus, there are a total of eight points of contact between the mooring unit 24 and the mooring unit platform 16. All eight points of contact are not shown in FIG. 5. Rather, FIG. 5 only shows two contact points 67 and 69; contact points 67 and 69 are two of four contact points which correspond to flange 64 of the left, or auxiliary, support frame 63. The load of the mooring unit 24 is transferred to the platform 16 through these eight contact points. The vessel 10 includes a support structure or foundation 13 for the platform 16. The support structure, or foundation, 13 for the platform 16 generally includes a series of steel beams 15 which tie into the respective vertical support columns 14, and is designed based upon the eight contact, or load bearing, points. Load cells (not shown) are positioned at each of the eight contact, or load bearing, points, and are connected to a conventional electrical tension system (not shown) for monitoring and controlling the tension in the mooring line.

Figure 3:
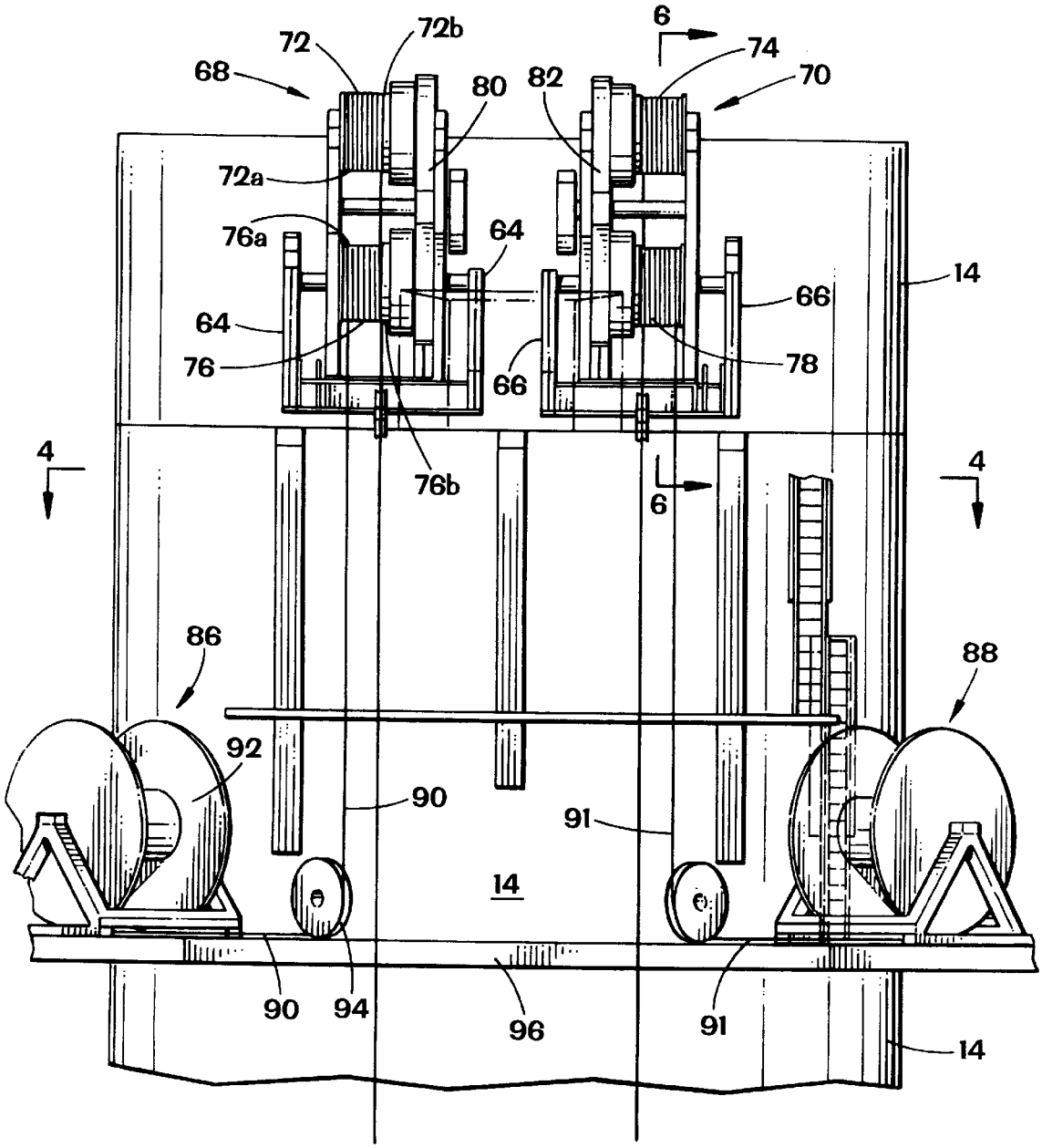
FIG. 3 is a front elevation view of the mooring unit of the present invention.
Figure 4:
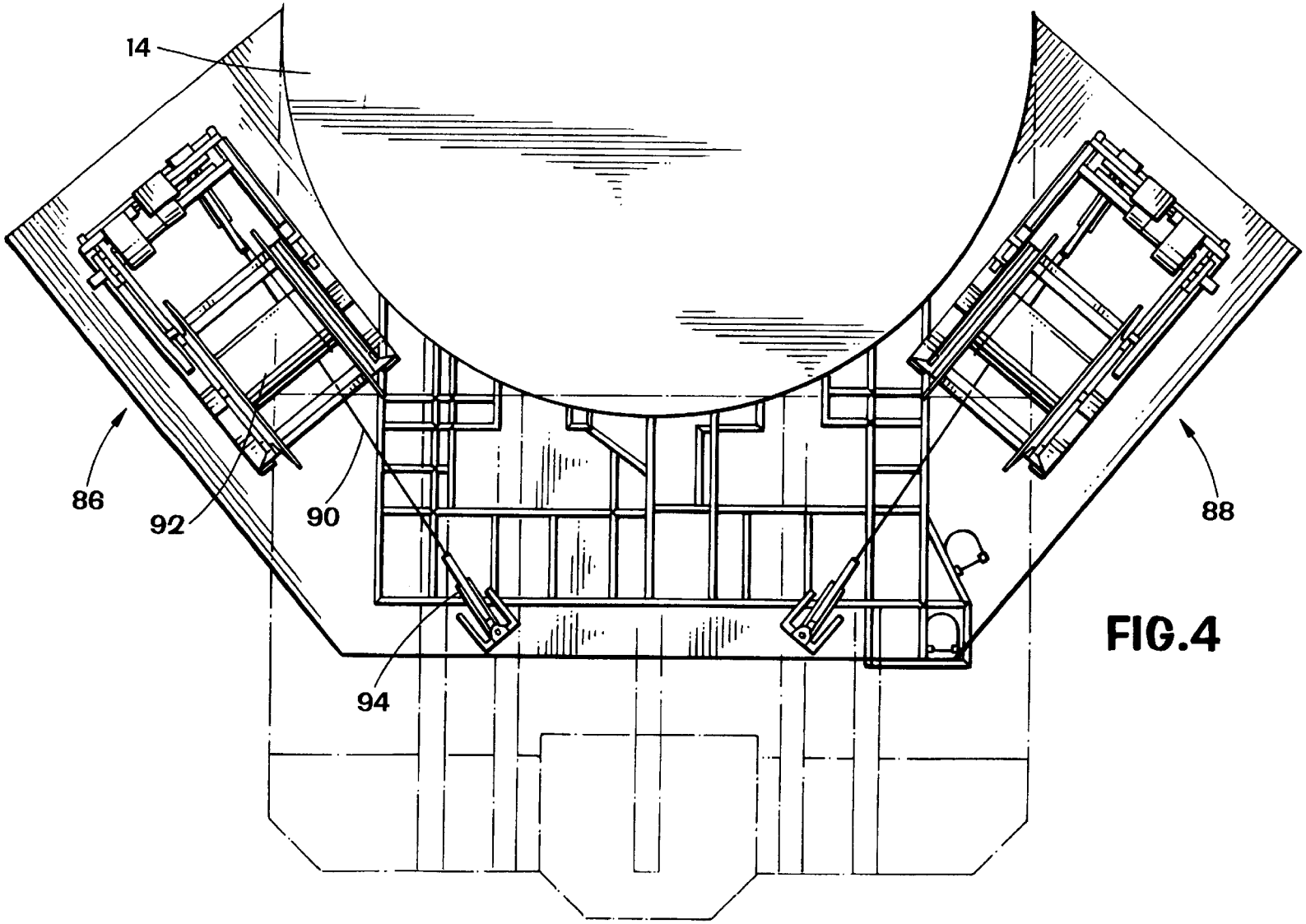
FIG. 4 is a top view of the mooring unit of the present invention taken along line 4—4 of FIG. 3.
Figure 6:
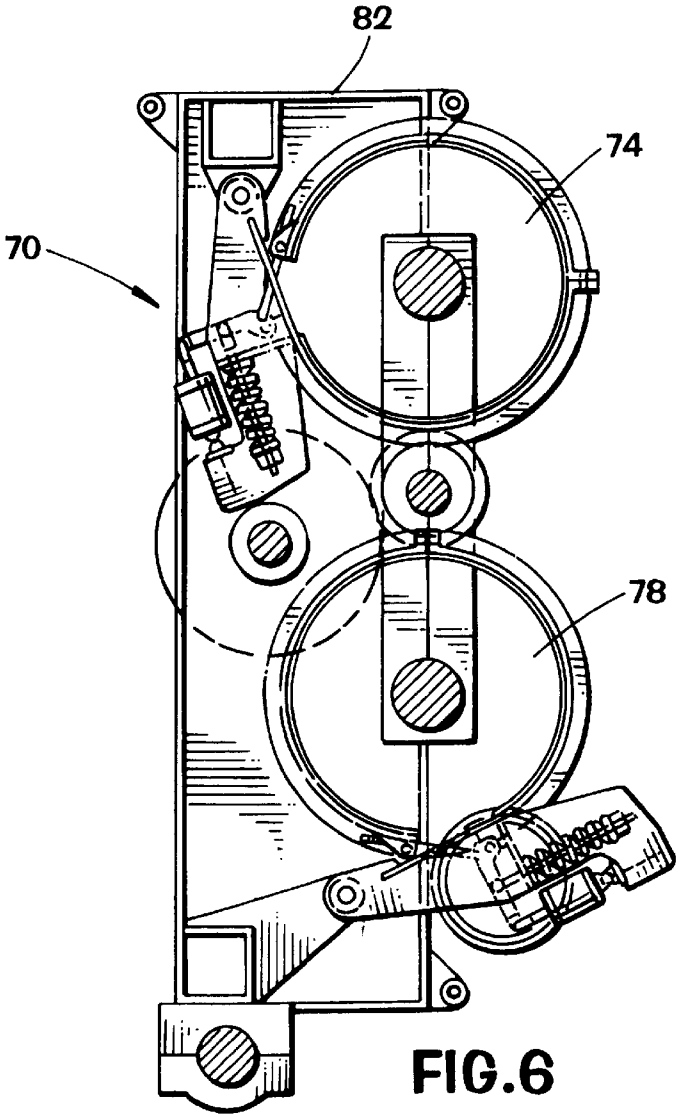
FIG. 6 is a side elevation view of one of the twin drum traction winch assemblies taken along line 6—6 of FIG. 3.

As explained above, a problem has developed with existing combination mooring units, such as mooring unit 24, when they have been used in water depths greater than those they were originally designed to operate in. To briefly summarize, the problem occurs when the anchors are being retrieved by the wire rope drums 30, 32 of the mooring unit 24. Referring to FIG. 1, and with reference to the left combination mooring unit 26, when the wire rope 42 is at its outer layer on the wire rope drum 30, the winch pull force is at its lowest magnitude. The winch drive train component stress levels are highest under the combined weight of the anchor (not shown), chain 38 and wire rope 42 as the winch raises the tri-link 34 up to the cross-over platform 18. The tri-link 34 must be at this point before the chain 38 can be connected directly to the chain 84 hanging from the windlass and disconnected from the short chain section 50 attached to the wire rope 42. As best shown in FIG. 3, in accordance with the present invention, the drive train stress levels are reduced by providing the mooring unit 24 with: left and right twin drum traction winch assemblies 68 and 70; and storage winches 86 and 88. The left and right twin drum traction winch assemblies 68 and 70 are vertically mounted on the left and right support flanges 64, 66 in place of the wire rope drums 30 and 32. The winches 86 and 88 are provided to hold the wire rope. The removed wire rope drums 30 and 32 and related levelwinds 53, 56 may be reused on the winches 86 and 88, or the winches 86 and 88 may be provided with wire rope drums capable of spooling greater lengths of wire rope. The winches 86 and 88 are preferably located below the mooring unit 24 on an existing, or new, platform 96 attached to the vertical column 14. The traction winch assemblies 68 and 70, which replace the wire rope drums 30 and 32, are designed to be mounted within the existing support flanges 64 and 66 (see FIGS. 1 and 2) without any modification to the flanges 64 and 66. The twin drum traction winch assemblies 68 and 70 are similar in design and construction to those of Model No. TMW/SW 350 mooring unit, which is manufactured by Skagit Products.

Referring to FIG. 3, in broad terms, each twin drum traction winch assembly 68 and 70 includes a top drum 72 and 74, a bottom drum 76 and 78, and a frame 80 and 82. The top drums 72, 74 and the bottoms drums 76, 78 are rotatably mounted opposite one another within the frames 80, 82. As known in the art, each drum 72–78 is grooved about its periphery. Referring to the left twin drum traction winch assembly 68, the wire rope 90 spools off the wire rope drum 92, passes around a pulley 94, and proceeds vertically upwardly to the bottom drum 76. The pulley 94 is positioned directly beneath the left-most grooves 72*a* and 76*a* on the top and bottom drums 72 and 76. Thus, as the wire rope 90 travels vertically upwardly from the pulley 94, it first makes contact with the left-most groove 76*a* on the bottom drum 76, then continues vertically upwardly to make contact with the left-most groove 72*a* on the top drum 72. The wire rope 90 wraps 180 degrees around the top drum 72, staying in the same groove 72*a*, and then travels vertically downwardly to the next groove on the bottom drum 76. The wire rope 90 continues to wrap around the top and bottom drums 72 and 76 until it reaches the right-most grooves 72*b* and 76*b*, from where the wire rope 90 travels vertically downwardly to be connected with the chain portion of the mooring line (not shown in this Figure).

The winch pull force of the twin drum traction winch assemblies 68 and 70 remains constant, since the wire rope 90 does not wind up in layers on the twin drums 72–78 of the twin drum traction winch assemblies 68 and 70, as it does on the wire rope drums 30 and 32 of the mooring unit 24. The diameters of the twin drums 72, 76 and 74, 78 on the traction winch assemblies 68 and 70 are identical and sized so the winch pull force for each drum 72–78 is substantially larger than the winch pull force at the outer layers of the wire rope drums 30 and 32. For example, the winch pull force at the core of the wire rope drums 30 and 32 may be approximately 730,000 pounds, but only 360,000 pounds at the outer layer. However, with the present invention, in a specific embodiment, the twin drums 72, 76 and 74, 78 may be sized such that they deliver a constant winch pull force of approximately 620,000 pounds. Thus, the mooring unit of the present invention does not suffer from the same problem associated with the wire rope drums 30 and 32 of the mooring unit 24. Instead, the mooring unit of the present invention will have far more winch pull force than is needed to pull the "tri-links" through the fairleads and up to the cross-over platform, where the combination wire rope and chain mooring line can be changed over to a chain only mooring line. Accordingly, by replacing the wire rope drums 30 and 32 with the twin drum traction winches 68 and 70, and by adding the storage winches 86 and 88, the present invention overcomes the above-described "drive train component stress level" problem associated with existing double-drum/double-wildcat combination mooring units.

The present invention has a number of advantages. First and foremost, the mooring unit 24 of the present invention will deliver a constant winch pull force well above the force needed to function properly. Thus, the stresses in the drive train components, such as the gears, shafts, bearings, etc., are kept within the allowable design criteria and the service life of the mooring unit 24 is thereby extended. In addition, by designing the twin drum traction winch assemblies 68 and 70 to mount directly on the existing support flanges 64 and 66, no modifications need to be made to the support frames 63 and 65. By using the existing support frames 63, 65, the loads associated with the mooring unit 24 are still directed through the same eight points as with the original design of the mooring unit 24. Thus, no changes need to be made to the support structure or foundation 13 for the mooring unit support platform 16. Similarly, the traction winch assemblies 68 and 70 are designed to work with the existing electrical control system, load cells and tension system, motor, and drive train components, such as the gears, shafts, bearings, etc. By solving the drive train component stress level problem without making numerous changes to the existing mooring unit or its support structure, tremendous savings in time, effort and expense are realized. Moreover, the mooring unit 24 of the present invention offers the ability to increase the wire rope capacity, which will enable the offshore drilling vessel to venture into still deeper and deeper water. For example, the wire rope drums 30 and 32 may have approximate wire rope capacities of 5,600 feet of three and one-half inch diameter wire rope each, whereas, with the present invention, in a specific embodiment, the storage winches 86 and 88 may be provided with wire rope drums having approximate wire rope capacities of 8,000 feet of three and one-half inch diameter wire rope each. Further, by moving the wire rope drums to a lower platform, the center of gravity for the drilling vessel is lowered, which increases the "variable deck load." This means that the platform of the drilling vessel is capable of holding more cargo. This is advantageous because, with a larger "variable deck load," fewer trips are needed to deliver drilling equipment, such as drill pipe, to the vessel, and fewer cargo delivery trips equates to savings in time, effort and expense.

It is to be understood that the invention is not limited to the exact details of construction, operation, exact materials or embodiments shown and described, as obvious modifications and equivalents will be apparent to one skilled in the art. For example, the present invention may be applied to existing single-drum/single wildcat mooring units, not only to double-drum/double wildcat combination mooring units of the type shown in FIGS. 1–5. Further, the method of the present invention may be applied to existing mooring units that use only a wire rope mooring line, as opposed to a combination wire rope and chain mooring line. In other words, the present invention may be applied to single-drum or double-drum mooring units that do not include a wildcat (s). Accordingly, the invention is therefore to be limited only by the scope of the appended claims.

I claim:

1. A method of retrofitting a mooring unit of the type used on an offshore drilling or production platform to pay out and retrieve a combination wire rope and chain mooring line, the mooring unit having a first combination mooring unit and a second combination mooring unit, the first combination mooring unit having a first support frame, a first wire rope drum for holding a first length of mooring wire rope, a first levelwind assembly for evenly spooling the first section of wire rope onto the first wire rope drum, a first wildcat rotatably mounted to the first support frame for retrieving and paying out a first section of mooring chain, the first support frame having a first wire rope support flange and a second wire rope support flange, the first wire rope drum being rotatably mounted within the first and second wire rope support flanges, the second combination mooring unit having a second support frame, a second wire rope drum for holding a second length of mooring wire rope, a second levelwind assembly for evenly spooling the second section of wire rope onto the second wire rope drum, a second wildcat rotatably mounted to the second support frame for retrieving and paying out a second section of mooring chain, the second support frame having a third wire rope support flange and a fourth wire rope support flange, the second wire rope drum being rotatably mounted within the third and fourth wire rope support flanges, the mooring unit further including a motor and means for transmitting power from the motor to the first wildcat, second wildcat, first wire rope drum, and second wire rope drum, the retrofitting method comprising the steps of:

removing the first wire rope drum and the first levelwind assembly from the first and second wire rope support flanges;

removing the second wire rope drum and the second levelwind assembly from the third and fourth wire rope support flanges;

mounting a first traction winch to the first and second wire rope support flanges to haul in and pay out the first section of wire rope;

mounting a second traction winch to the third and fourth wire rope support flanges to haul in and pay out the second section of wire rope;

mounting a third wire rope drum assembly on the offshore platform adjacent the mooring unit to store the first section of wire rope; and, mounting a fourth wire rope drum assembly on the offshore platform adjacent the mooring unit to store the second section of wire rope.

2. The method of claim 1, wherein the first traction winch is mounted to the first and second wire rope support flanges without making any modification to the first or second wire rope support flanges, and wherein the second traction winch is mounted to the third and fourth wire rope support flanges without making any modification to the third or fourth wire rope support flanges.

3. The method of claim 1, wherein the first traction winch is mounted to the first and second wire rope support flanges without making any modification to the power transmission means, and wherein the second traction winch is mounted to the third and fourth wire rope support flanges without making any modification to the power transmission means.

4. The method of claim 1, wherein the first and second support frames are connected to the offshore platform, there being a first and a second point of contact between the first wire rope support flange and the platform, a third and a fourth point of contact between the second wire rope support flange and the platform, a fifth and a sixth point of contact between the third wire rope support flange and the platform, and a seventh and an eighth point of contact between the fourth wire rope support flange and the platform, such that forces associated with the mooring line are transferred through the points of contact to the platform, and wherein the first traction winch is mounted to the first and second wire rope support flanges without altering the first, second, third or fourth contact points, and the second traction winch is mounted to the third and fourth wire rope support flanges without altering the fifth, sixth, seventh, or eighth contact points.

5. The method of claim 1, wherein the first and second support frames are connected to the offshore platform, there being a plurality of points of contact between the support flanges and the platform, such that forces associated with the mooring line are transferred through the points of contact to the platform, and wherein the first traction winch is mounted to the first and second wire rope support flanges without altering any of the contacts points, and the second traction winch is mounted to the third and fourth wire rope support flanges without altering any of the contact points.

6. The method of claim 1, wherein the first and second traction winches are vertically mounted to the support flanges.

7. The method of claim 1, wherein the third wire rope drum assembly is mounted below the mooring unit such that the first section of wire rope is directed from the third wire rope drum assembly upwardly to the first traction winch, and wherein the fourth wire rope drum assembly is mounted below the mooring unit such that the second section of wire rope is directed from the fourth wire rope drum assembly upwardly to the second traction winch.

8. The method of claim 7, further including the steps of mounting a first pulley to the offshore platform and mounting a second pulley to the offshore platform, such that the first section of wire rope is directed from the third wire rope drum assembly around the first pulley and then upwardly to the first traction winch, and the second section of wire rope is directed from the fourth wire rope drum assembly around the second pulley and then upwardly to the second traction winch.

9. The method of claim 8, wherein the first pulley is mounted to the offshore platform directly beneath a first left-most groove on a first bottom drum of the first traction winch, and the second pulley is mounted to the offshore platform directly beneath a second left-most groove on a second bottom drum of the second traction winch.

10. The method of claim 1, wherein the third wire rope drum assembly includes the first wire rope drum and first levelwind assembly.

11. The method of claim 10, wherein the third wire rope drum assembly is mounted below the mooring unit such that the first section of wire rope is directed from the third wire rope drum assembly upwardly to the first traction winch.

12. The method of claim 11, further including the step of mounting a first pulley to the offshore platform such that the first section of wire rope is directed from the third wire rope drum assembly around the first pulley and then upwardly to the first traction winch.

13. The method of claim 12, wherein the first pulley is mounted to the offshore platform directly beneath a first left-most groove on a first bottom drum of the first traction winch.

14. The method of claim 1, wherein the fourth wire rope drum assembly includes the second wire rope drum and second levelwind assembly.

15. The method of claim 14, wherein the fourth wire rope drum assembly is mounted below the mooring unit such that the second section of wire rope is directed from the second wire rope drum assembly upwardly to the second traction winch.

16. The method of claim 15, further including the step of mounting a second pulley to the offshore platform, such that the second section of wire rope is directed from the fourth wire rope drum assembly around the second pulley and then upwardly to the second traction winch.

17. The method of claim 16, wherein the second pulley is mounted to the offshore platform directly beneath a second left-most groove on a second bottom drum of the second traction winch.

18. A method of retrofitting a mooring unit of the type used on an offshore drilling or production platform to pay out and retrieve a combination wire rope and chain mooring line, the mooring unit having a first combination mooring unit, the first combination mooring unit having a first support frame, a first wire rope drum for holding a first length of mooring wire rope, a first levelwind assembly for evenly spooling the first section of wire rope onto the first wire rope drum, a first wildcat rotatably mounted to the first support frame for retrieving and paying out a first section of mooring chain, the first support frame having a first wire rope support flange and a second wire rope support flange, the first wire rope drum being rotatably mounted within the first and second wire rope support flanges, the mooring unit further including a motor and means for transmitting power from the motor to the first wildcat and first wire rope drum, the retrofitting method comprising the steps of:

removing the first wire rope drum and the first levelwind assembly from the first and second wire rope support flanges;

mounting a first traction winch to the first and second wire rope support flanges to haul in and pay out the first section of wire rope; and, mounting a wire rope drum assembly on the offshore platform adjacent the mooring unit to store the first section of wire rope.

19. The method of claim 18, wherein the first traction winch is mounted to the first and second wire rope support flanges without making any modification to the first or second wire rope support flanges.

20. The method of claim 18, wherein the first traction winch is mounted to the first and second wire rope support flanges without making any modification to the power transmission means.

21. The method of claim 18, wherein the first support frame is connected to the offshore platform, there being a first and a second point of contact between the first wire rope support flange and the platform, and a third and a fourth point of contact between the second wire rope support flange and the platform, such that forces associated with the mooring line are transferred through the points of contact to the platform, and wherein the first traction winch is mounted to the first and second wire rope support flanges without altering the first, second, third or fourth contact points.

22. The method of claim 18, wherein the first support frame is connected to the offshore platform, there being a plurality of points of contact between the support flange and the platform, such that forces associated with the mooring line are transferred through the points of contact to the platform, and wherein the first traction winch is mounted to the first and second wire rope support flanges without altering any of the contacts points.

23. The method of claim 18, wherein the first traction winches is vertically mounted to the first support flange.

24. The method of claim 18, wherein the wire rope drum assembly is mounted below the mooring unit such that the first section of wire rope is directed from the wire rope drum assembly upwardly to the first traction winch.

25. The method of claim 24, further including the step of mounting a first pulley to the offshore platform such that the first section of wire rope is directed from the wire rope drum assembly around the first pulley and then upwardly to the first traction winch.

26. The method of claim 25, wherein the first pulley is mounted to the offshore platform directly beneath a first left-most groove on a first bottom drum of the first traction winch.

27. The method of claim 18, wherein the wire rope drum assembly includes the first wire rope drum and first levelwind assembly.

28. The method of claim 27, wherein the wire rope drum assembly is mounted below the mooring unit such that the first section of wire rope is directed from the third wire rope drum assembly upwardly to the first traction winch.

29. The method of claim 28, further including the step of mounting a first pulley to the offshore platform such that the first section of wire rope is directed from the wire rope drum assembly around the first pulley and then upwardly to the first traction winch.

30. The method of claim 29, wherein the first pulley is mounted to the offshore platform directly beneath a first left-most groove on a first bottom drum of the first traction winch.

31. A method of retrofitting a mooring unit of the type used on an offshore drilling or production platform to pay out and retrieve a wire rope mooring line, the mooring unit having a first winch and a second winch, the first winch having a first support frame, a first wire rope drum for holding a first length of mooring wire rope, a first levelwind assembly for evenly spooling the first section of wire rope onto the first wire rope drum, the first support frame having a first wire rope support flange and a second wire rope support flange, the first wire rope drum being rotatably mounted within the first and second wire rope support flanges, the second winch having a second support frame, a second wire rope drum for holding a second length of mooring wire rope, a second levelwind assembly for evenly spooling the second section of wire rope onto the second wire rope drum, the second support frame having a third wire rope support flange and a fourth wire rope support flange, the second wire rope drum being rotatably mounted within the third and fourth wire rope support flanges, the mooring unit further including a motor and means for transmitting power from the motor to the first wire rope drum and second wire rope drum, the retrofitting method comprising the steps of:

removing the first wire rope drum and the first levelwind assembly from the first and second wire rope support flanges;

removing the second wire rope drum and the second levelwind assembly from the third and fourth wire rope support flanges;

mounting a first traction winch to the first and second wire rope support flanges to haul in and pay out the first section of wire rope;

mounting a second traction winch to the third and fourth wire rope support flanges to haul in and pay out the second section of wire rope;

mounting a third wire rope drum assembly on the offshore platform adjacent the mooring unit to store the first section of wire rope; and, mounting a fourth wire rope drum assembly on the offshore platform adjacent the mooring unit to store the second section of wire rope.

32. The method of claim 31, wherein the first traction winch is mounted to the first and second wire rope support flanges without making any modification to the first or second wire rope support flanges, and wherein the second traction winch is mounted to the third and fourth wire rope support flanges without making any modification to the third or fourth wire rope support flanges.

33. The method of claim 31, wherein the first traction winch is mounted to the first and second wire rope support flanges without making any modification to the power transmission means, and wherein the second traction winch is mounted to the third and fourth wire rope support flanges without making any modification to the power transmission means.

34. The method of claim 31, wherein the first and second support frames are connected to the offshore platform, there being a first and a second point of contact between the first wire rope support flange and the platform, a third and a fourth point of contact between the second wire rope support flange and the platform, a fifth and a sixth point of contact between the third wire rope support flange and the platform, and a seventh and an eighth point of contact between the fourth wire rope support flange and the platform, such that forces associated with the mooring line are transferred through the points of contact to the platform, and wherein the first traction winch is mounted to the first and second wire rope support flanges without altering the first, second, third or fourth contact points, and the second traction winch is mounted to the third and fourth wire rope support flanges without altering the fifth, sixth, seventh, or eighth contact points.

35. The method of claim 31, wherein the first and second support frames are connected to the offshore platform, there being a plurality of points of contact between the support flanges and the platform, such that forces associated with the mooring line are transferred through the points of contact to the platform, and wherein the first traction winch is mounted to the first and second wire rope support flanges without altering any of the contacts points, and the second traction winch is mounted to the third and fourth wire rope support flanges without altering any of the contact points.

36. The method of claim 31, wherein the first and second traction winches are vertically mounted to the support flanges.

37. The method of claim 31, wherein the third wire rope drum assembly is mounted below the mooring unit such that the first section of wire rope is directed from the third wire rope drum assembly upwardly to the first traction winch, and wherein the fourth wire rope drum assembly is mounted below the mooring unit such that the second section of wire rope is directed from the fourth wire rope drum assembly upwardly to the second traction winch.

38. The method of claim 37, further including the steps of mounting a first pulley to the offshore platform and mounting a second pulley to the offshore platform, such that the first section of wire rope is directed from the third wire rope drum assembly around the first pulley and then upwardly to the first traction winch, and the second section of wire rope is directed from the fourth wire rope drum assembly around the second pulley and then upwardly to the second traction winch.

39. The method of claim 38, wherein the first pulley is mounted to the offshore platform directly beneath a first left-most groove on a first bottom drum of the first traction winch, and the second pulley is mounted to the offshore platform directly beneath a second left-most groove on a second bottom drum of the second traction winch.

40. The method of claim 31, wherein the third wire rope drum assembly includes the first wire rope drum and first levelwind assembly.

41. The method of claim 40, wherein the third wire rope drum assembly is mounted below the mooring unit such that the first section of wire rope is directed from the third wire rope drum assembly upwardly to the first traction winch.

42. The method of claim 41, further including the step of mounting a first pulley to the offshore platform such that the first section of wire rope is directed from the third wire rope drum assembly around the first pulley and then upwardly to the first traction winch.

43. The method of claim 42, wherein the first pulley is mounted to the offshore platform directly beneath a first left-most groove on a first bottom drum of the first traction winch.

44. The method of claim 31, wherein the fourth wire rope drum assembly includes the second wire rope drum and second levelwind assembly.

45. The method of claim 44, wherein the fourth wire rope drum assembly is mounted below the mooring unit such that the second section of wire rope is directed from the second wire rope drum assembly upwardly to the second traction winch.

46. The method of claim 45, further including the step of mounting a second pulley to the offshore platform, such that the second section of wire rope is directed from the fourth wire rope drum assembly around the second pulley and then upwardly to the second traction winch.

47. The method of claim 46, wherein the second pulley is mounted to the offshore platform directly beneath a second left-most groove on a second bottom drum of the second traction winch.

48. A method of retrofitting a mooring unit of the type used on an offshore drilling or production platform to pay out and retrieve a wire rope mooring line, the mooring unit having a first winch, the first winch having a first support frame, a first wire rope drum for holding a first length of mooring wire rope, a first levelwind assembly for evenly spooling the first section of wire rope onto the first wire rope drum, the first support frame having a first wire rope support flange and a second wire rope support flange, the first wire rope drum being rotatably mounted within the first and second wire rope support flanges, the mooring unit further including a motor and means for transmitting power from the motor to the first wire rope drum, the retrofitting method comprising the steps of:

removing the first wire rope drum and the first levelwind assembly from the first and second wire rope support flanges;

mounting a first traction winch to the first and second wire rope support flanges to haul in and pay out the first section of wire rope; and, mounting a wire rope drum assembly on the offshore platform adjacent the mooring unit to store the first section of wire rope.

49. The method of claim 48, wherein the first traction winch is mounted to the first and second wire rope support flanges without making any modification to the first or second wire rope support flanges.

50. The method of claim 48, wherein the first traction winch is mounted to the first and second wire rope support flanges without making any modification to the power transmission means.

51. The method of claim 48, wherein the first support frame is connected to the offshore platform, there being a first and a second point of contact between the first wire rope support flange and the platform, and a third and a fourth point of contact between the second wire rope support flange and the platform, such that forces associated with the mooring line are transferred through the points of contact to the platform, and wherein the first traction winch is mounted to the first and second wire rope support flanges without altering the first, second, third or fourth contact points.

52. The method of claim 48, wherein the first support frame is connected to the offshore platform, there being a plurality of points of contact between the support flange and the platform, such that forces associated with the mooring line are transferred through the points of contact to the platform, and wherein the first traction winch is mounted to the first and second wire rope support flanges without altering any of the contacts points.

53. The method of claim 48, wherein the first traction winches is vertically mounted to the first support flange.

54. The method of claim 48, wherein the wire rope drum assembly is mounted below the mooring unit such that the first section of wire rope is directed from the wire rope drum assembly upwardly to the first traction winch.

55. The method of claim 54, further including the step of mounting a first pulley to the offshore platform such that the first section of wire rope is directed from the wire rope drum assembly around the first pulley and then upwardly to the first traction winch.

56. The method of claim 55, wherein the first pulley is mounted to the offshore platform directly beneath a first left-most groove on a first bottom drum of the first traction winch.

57. The method of claim 48, wherein the wire rope drum assembly includes the first wire rope drum and first level-wind assembly.

58. The method of claim 57, wherein the wire rope drum assembly is mounted below the mooring unit such that the first section of wire rope is directed from the wire rope drum assembly upwardly to the first traction winch.

59. The method of claim 58, further including the step of mounting a first pulley to the offshore platform such that the first section of wire rope is directed from the wire rope drum assembly around the first pulley and then upwardly to the first traction winch.

60. The method of claim 59, wherein the first pulley is mounted to the offshore platform directly beneath a first left-most groove on a first bottom drum of the first traction winch.

61. A system for mooring an offshore drilling or production platform to the ocean floor with a combination wire rope and chain mooring line connected to an anchor, the system comprising:

a first combination mooring unit having a first support frame, a first wildcat rotatably mounted to the first support frame for retrieving and paying out a first section of mooring chain, the first support frame having a first wire rope support flange and a second wire rope support flange, a first traction winch mounted to the first and second wire rope support flanges to haul in and pay out a first section of wire rope;

a second combination mooring unit having a second support frame, a second wildcat rotatably mounted to the second support frame for retrieving and paying out a second section of mooring chain, the second support frame having a third wire rope support flange and a fourth wire rope support flange, a second traction winch mounted to the third and fourth wire rope support flanges to haul in and pay out a second section of wire rope;

a motor;

means for transmitting power from the motor to the first wildcat, second wildcat, first traction winch, and second traction winch;

a first wire rope drum assembly mounted to the offshore platform adjacent the first combination mooring unit to store the first section of wire rope; and, a second wire rope drum assembly mounted to the offshore platform adjacent the second combination mooring unit to store the second section of wire rope.

62. The system of claim 61, wherein the first and second traction winches are vertically mounted to the support flanges.

63. The system of claim 61, wherein the first wire rope drum assembly is mounted below the first combination mooring unit such that the first section of wire rope is directed from the third wire rope drum assembly upwardly to the first traction winch, and wherein the second wire rope drum assembly is mounted below the second combination mooring unit such that the second section of wire rope is directed from the second wire rope drum assembly upwardly to the second traction winch.

64. The system of claim 63, further including a first pulley mounted to the offshore platform and a second pulley mounted to the offshore platform, the first section of wire rope begin directed from the first wire rope drum assembly around the first pulley and then upwardly to the first traction winch, and the second section of wire rope being directed from the second wire rope drum assembly around the second pulley and then upwardly to the second traction winch.

65. The system of claim 64, wherein the first pulley is mounted to the offshore platform directly beneath a first left-most groove on a first bottom drum of the first traction winch, and the second pulley is mounted to the offshore platform directly beneath a second left-most groove on a second bottom drum of the second tradition winch.

* * * * *